US010208999B2

(12) United States Patent
Vijayan et al.

(10) Patent No.: US 10,208,999 B2
(45) Date of Patent: Feb. 19, 2019

(54) REFRIGERATION HEATING ASSEMBLY AND METHOD OF OPERATION

(71) Applicant: Haier US Appliance Solutions, Inc., Wilmington, DE (US)

(72) Inventors: Vineeth Vijayan, Louisville, KY (US); Martin Mitchell Zentner, Prospect, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 212 days.

(21) Appl. No.: 15/447,305

(22) Filed: Mar. 2, 2017

(65) Prior Publication Data

US 2018/0252462 A1 Sep. 6, 2018

(51) Int. Cl.
*H05B 1/02* (2006.01)
*H05B 3/00* (2006.01)
(Continued)

(52) U.S. Cl.
CPC ..... *F25D 21/08* (2013.01); *F25D 11/02* (2013.01); *F25D 29/006* (2013.01); *H05B 1/0252* (2013.01); *H05B 3/0071* (2013.01); *H05B 3/40* (2013.01); *H05B 3/42* (2013.01); *H05B 3/44* (2013.01); *F25D 2700/12* (2013.01); *F25D 2700/122* (2013.01); *H05B 2203/032* (2013.01); *H05B 2214/02* (2013.01)

(58) Field of Classification Search
CPC .... H05B 1/0252; H05B 1/028; H05B 1/0291; H05B 3/0071; H05B 3/023; H05B 3/0004; H05B 3/0009; H05B 3/40; H05B 3/42; H05B 3/44; H05B 2214/02; F25D 21/08; F25D 21/006; F25D 21/002; F25D 21/004; F25D 21/025; F25D 2321/1413
USPC ..... 219/544; 392/407, 408
See application file for complete search history.

(56) References Cited

U.S. PATENT DOCUMENTS 3,974,418 A * 8/1976 Fridrich ..... F21V 15/015 315/59
5,155,798 A * 10/1992 Van Denend ..... H05B 3/009 338/234

(Continued)

FOREIGN PATENT DOCUMENTS

JP 03404395 B2 5/2003
JP 2003/343969 A 12/2003

*Primary Examiner* — Keith M Raymond
*Assistant Examiner* — Miguel A Diaz
(74) *Attorney, Agent, or Firm* — Dority & Manning, P.A.

(57) ABSTRACT

A refrigeration heating assembly and method of operation are generally provided herein. The heating assembly may include an inner glass tube, a resistive heating element, an outer glass tube, a first end cap, a second end cap, and a sensor assembly. The inner glass tube may include a continuous inner wall defining a central passage. The resistive heating element may be disposed within the central passage. The outer glass tube may include a continuous outer wall disposed about the inner glass tube. A radial gap may be defined between the glass tubes. The first end cap may be positioned on the outer glass tube and the inner glass tube at a first end. The second end cap may be positioned on the outer glass tube and the inner glass tube at a second end. The sensor assembly may be disposed in fluid communication with the radial gap.

20 Claims, 5 Drawing Sheets

(51) Int. Cl.

| | |
|---|---|
| ***H05B 3/40*** | (2006.01) |
| ***H05B 3/42*** | (2006.01) |
| ***H05B 3/44*** | (2006.01) |
| ***F25D 21/08*** | (2006.01) |
| ***F25D 29/00*** | (2006.01) |
| ***F25D 11/02*** | (2006.01) |

(56) References Cited

U.S. PATENT DOCUMENTS 5,545,878 A * 8/1996 Jasper, II ..... F25D 21/08 219/541
5,552,581 A * 9/1996 Jasper, II ..... F25D 21/08 219/523
5,968,397 A * 10/1999 Wyland ..... H01J 61/52 219/405
6,124,579 A * 9/2000 Steinhauser ..... H05B 1/0291 219/523
6,140,623 A * 10/2000 Boehnlein ..... F25D 21/08 219/536
6,626,004 B2 * 9/2003 Lee ..... F25D 21/08 392/480
6,684,659 B1 * 2/2004 Tanaka ..... F25D 21/08 219/523
7,215,879 B2 5/2007 Morikawa et al.
7,308,804 B2 12/2007 Onishi et al.
7,639,930 B2 * 12/2009 Mizukawa ..... H01K 1/16 392/407
2004/0149733 A1 8/2004 Abbott et al.
2004/0237560 A1 * 12/2004 Onishi ..... F25D 21/08 62/276
2005/0069308 A1 * 3/2005 Morikawa ..... F25D 21/08 392/407
2010/0298738 A1 * 11/2010 Felts ..... B05D 1/62 600/576
2011/0061444 A1 * 3/2011 Suzuki ..... B23K 35/30 73/25.01
2013/0315575 A1 * 11/2013 DeSantiago ..... H01K 1/18 392/407
2014/0355971 A1 * 12/2014 DeSantiago ..... H05B 3/44 392/407
2015/0341987 A1 * 11/2015 Bernstein ..... H05B 3/54 392/407
2016/0073694 A1 * 3/2016 Liu ..... H05B 3/40 131/329
2017/0131019 A1 * 5/2017 Junge ..... F25D 21/08
2018/0135906 A1 * 5/2018 Junge ..... F25D 21/08
2018/0299183 A1 * 10/2018 Vijayan ..... F25D 21/08

* cited by examiner

REFRIGERATION HEATING ASSEMBLY AND METHOD OF OPERATION

FIELD OF THE INVENTION

The present subject matter relates generally to electrical heating assemblies, and more particularly to heating assemblies for refrigerator appliances.

BACKGROUND OF THE INVENTION

Refrigerators or refrigerator appliances generally include a cabinet that defines a chilled chamber. The chilled chamber is commonly cooled with a sealed system having an evaporator. One problem that may be encountered with existing refrigerator appliances is inefficient defrosting of the evaporator. For example, when the evaporator is active, frost can accumulate on the evaporator and thereby reduce efficiency of the evaporator. One effort to reduce or eliminate frost from the evaporator has been to utilize a heater, such as an electrical heater, to heat the evaporator, e.g., when the evaporator is not operating.

Utilizing an electrical heater to defrost an evaporator can pose certain challenges. For example, certain refrigerators utilize a flammable refrigerant within the sealed system. In such systems, a surface temperature of the heater is generally limited to a temperature well below the auto-ignition temperature of the flammable refrigerant. However, the evaporator generally requires a certain power output from the heater to suitably defrost. Moreover, it is possible that a portion of electrical heater may fail. As an example, in the case of a single or dual glass tube heater, one or more of the glass tubes may crack or rupture. If such a crack or rupture occurs, refrigerant could be exposed to temperatures in excess of the refrigerant's auto-ignition temperature.

Accordingly, a heating assembly with certain safety features would be useful. In particular, a heating assembly that is configured to detect and respond to damage suffered by the heating assembly would be useful. For instance, it would be advantageous to detect a crack or rupture in a tube of a heater assembly. Moreover, it may also be useful to have a refrigerator appliance with a heating assembly for defrosting an evaporator of the refrigerator appliance, while also operating at a surface temperature well below an auto-ignition temperature of a flammable refrigerant within the evaporator.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet defining a chilled chamber, a sealed system, and an electrical heater. The sealed system may include an evaporator disposed at the chilled chamber a sealed system comprising an evaporator, the evaporator disposed at the chilled chamber. The electrical heater may include an inner glass tube, a resistive heating element, an outer glass tube, a first end cap, a second end cap, and a sensor assembly. The inner glass tube may include a continuous inner wall defining a central passage extending from a first end to a second end. The resistive heating element may be disposed within the central passage. The outer glass tube may include a continuous outer wall disposed about the inner glass tube. A radial gap may be defined between the outer glass tube and the inner glass tube. The first end cap may be positioned on the outer glass tube and the inner glass tube at the first end. The second end cap may be positioned on the outer glass tube and the inner glass tube at the second end. The sensor assembly may be disposed in fluid communication with the radial gap.

In another aspect of the present disclosure, a defrost heater for a refrigeration assembly is provided. The defrost heater may include an inner glass tube, a resistive heating element, an outer glass tube, a first end cap, a second end cap, and a sensor assembly. The inner glass tube may include a continuous inner wall defining a central passage extending from a first end to a second end. The resistive heating element may be disposed within the central passage. The outer glass tube may include a continuous outer wall disposed about the inner glass tube. A radial gap may be defined between the outer glass tube and the inner glass tube. The first end cap may be positioned on the outer glass tube and the inner glass tube at the first end. The second end cap may be positioned on the outer glass tube and the inner glass tube at the second end. The sensor assembly may be disposed in fluid communication with the radial gap.

In yet another aspect of the present disclosure, a method of operating a refrigeration system is provided. The refrigeration system may include an electrical heater may include a pair of an inner and an outer glass tube defining a radial gap therebetween, a resistive heating element disposed within the inner glass tube, and a sensor assembly in operable communication with the electrical heater. The method may include receiving a condition signal from the sensor assembly, determining a heater condition value based on the condition signal, comparing the heater condition value to a threshold, determining an integrity state of the outer glass tube based on the comparing, and restricting activation of the resistive heating element based on the determined integrity state.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
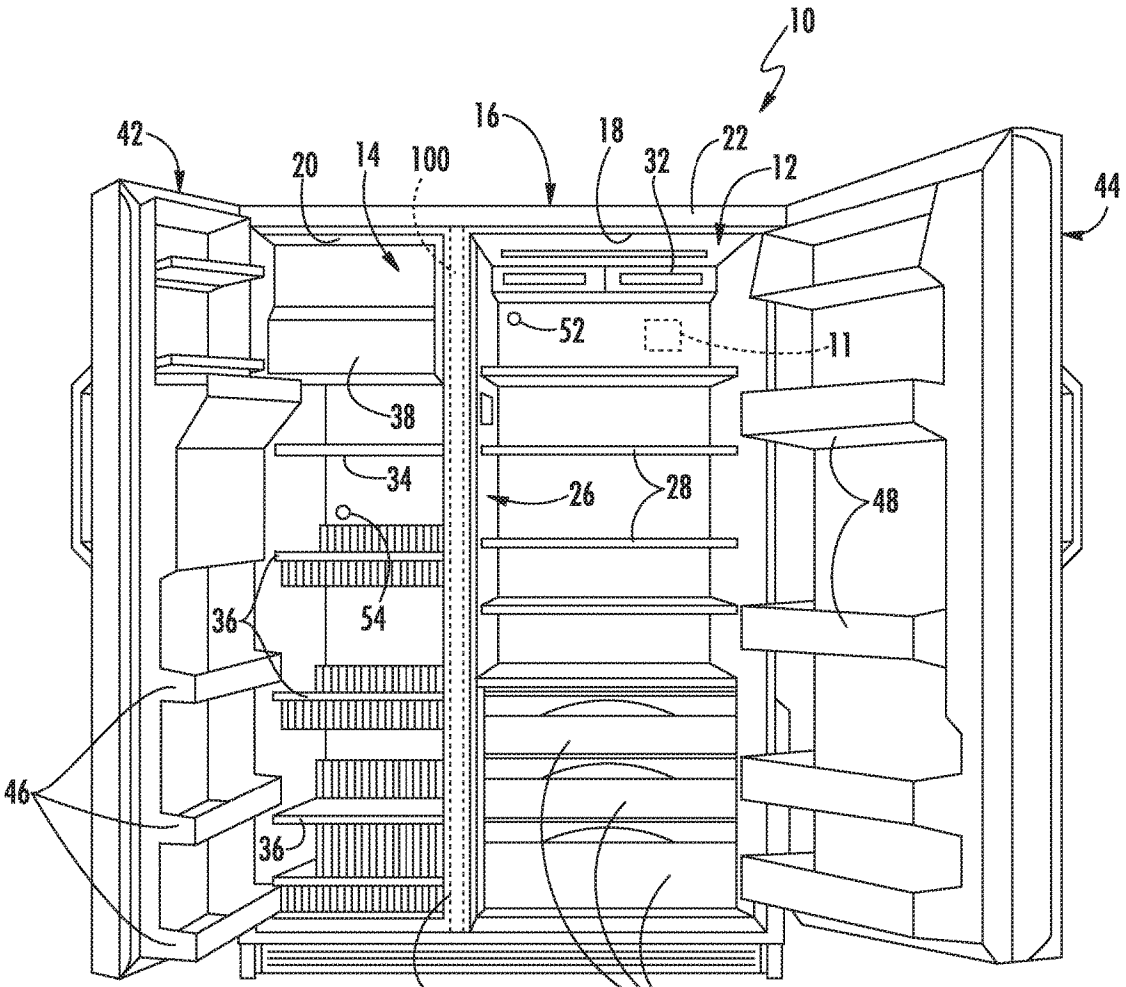
FIG. 1 provides a front perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides a heating assembly for use in, as an example, a refrigerator appliance. The heating assembly may assist in defrosting one or more portions of a sealed cooling circuit in the refrigerator appliance. The heating assembly may include an electrical heater that has an outer glass tube and inner glass tube that enclose a resistive heating element. A radial gap is provided between the inner and outer glass tubes. One or more sensors may detect conditions within the glass tubes, to determine if/when the outer glass tube has broken.

Turning now to the figures, FIG. 1 provides a front view of a representative refrigerator appliance 10 according to example embodiments of the present disclosure. More specifically, for illustrative purposes, the present disclosure is described with a refrigerator appliance 10 having a construction as shown and described further below. As used herein, a refrigerator appliance includes appliances such as a refrigerator/freezer combination, side-by-side, bottom mount, compact, and any other style or model of refrigerator appliance. Accordingly, other configurations including multiple and different styled compartments could be used with refrigerator appliance 10, it being understood that the configuration shown in FIG. 1 is by way of example only.

Refrigerator appliance 10 includes a fresh food storage compartment 12 and a freezer storage compartment 14. Freezer compartment 14 and fresh food compartment 12 are arranged side-by-side within an outer case 16 and defined by inner liners 18 and 20 therein. A space between case 16 and liners 18, 20 and between liners 18, 20 may be filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator appliance 10 includes shelves 28 and slide-out storage drawers 30, sometimes referred to as storage pans, which normally are provided in fresh food compartment 12 to support items being stored therein.

Refrigerator appliance 10 can be operated by one or more controllers 11 or other processing devices according to programming and/or user preference via manipulation of a control interface 32 mounted, e.g., in an upper region of fresh food storage compartment 12 and connected with controller 11. Controller 11 may include one or more memory devices and one or more microprocessors, such as a general or special purpose microprocessor operable to execute programming instructions or micro-control code associated with the operation of the refrigerator appliance 10. The memory devices or memory may represent random access memory such as DRAM, or read only memory such as ROM or FLASH. The memory may be a separate component from the processor or may be included onboard within the processor. The memory can store information accessible to processing device, including instructions that can be executed by processing device. Optionally, the instructions can be software or any set of instructions that, when executed by the processing device, cause the processing device to perform operations. For certain embodiments, the instructions include a software package configured to operate appliance 10 and initiate one or more predetermined sequences (e.g., a heater monitoring sequence). For example, the instructions may include a software package configured to execute the example method 500, described below with reference to FIG. 5.

Controller 11 may include one or more proportional-integral ("PI") controllers programmed, equipped, or configured to operate the refrigerator appliance according to example aspects of the control methods set forth herein. Accordingly, as used herein, "controller" includes the singular and plural forms.

Controller 11 may be positioned in a variety of locations throughout refrigerator appliance 10. In the illustrated embodiment, controller 11 may be located e.g., behind an interface panel 32 or doors 42 or 44. Input/output ("I/O") signals may be routed between the control system and various operational components of refrigerator appliance 10 along wiring harnesses that may be routed through, for example, the back, sides, or mullion 26. Typically, through user interface panel 32, a user may select various operational features and modes and monitor the operation of refrigerator appliance 10. In one embodiment, the user interface panel 32 may represent a general purpose I/O ("GPIO") device or functional block. In one embodiment, the user interface panel 32 may include input components, such as one or more of a variety of electrical, mechanical or electro-mechanical input devices including rotary dials, push buttons, and touch pads. The user interface panel 32 may include a display component, such as a digital or analog display device designed to provide operational feedback to a user. User interface panel 32 may be in communication with controller 11 via one or more signal lines or shared communication busses.

In some embodiments, one or more temperature sensors are provided to measure the temperature in the fresh food compartment 12 and the temperature in the freezer compartment 14. For example, a first temperature sensor 52 may be disposed in the fresh food compartment 12 and may measure the temperature in the fresh food compartment 12. A second temperature sensor 54 may be disposed in the freezer compartment 14 and may measure the temperature in the freezer compartment 14. This temperature information can be provided, e.g., to controller 11 for use in operating refrigerator 10. These temperature measurements may be taken intermittently or continuously during operation of the appliance 10 and/or execution of a control system.

A shelf 34 and wire baskets 36 are also provided in freezer compartment 14. In addition, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. In alternative embodiments, one or both doors 42, 44 may be slidable or otherwise movable between open and closed positions. Freezer door 42 includes a plurality of storage shelves 46, and fresh food door 44 includes a plurality of storage shelves 48.

Figure 2:
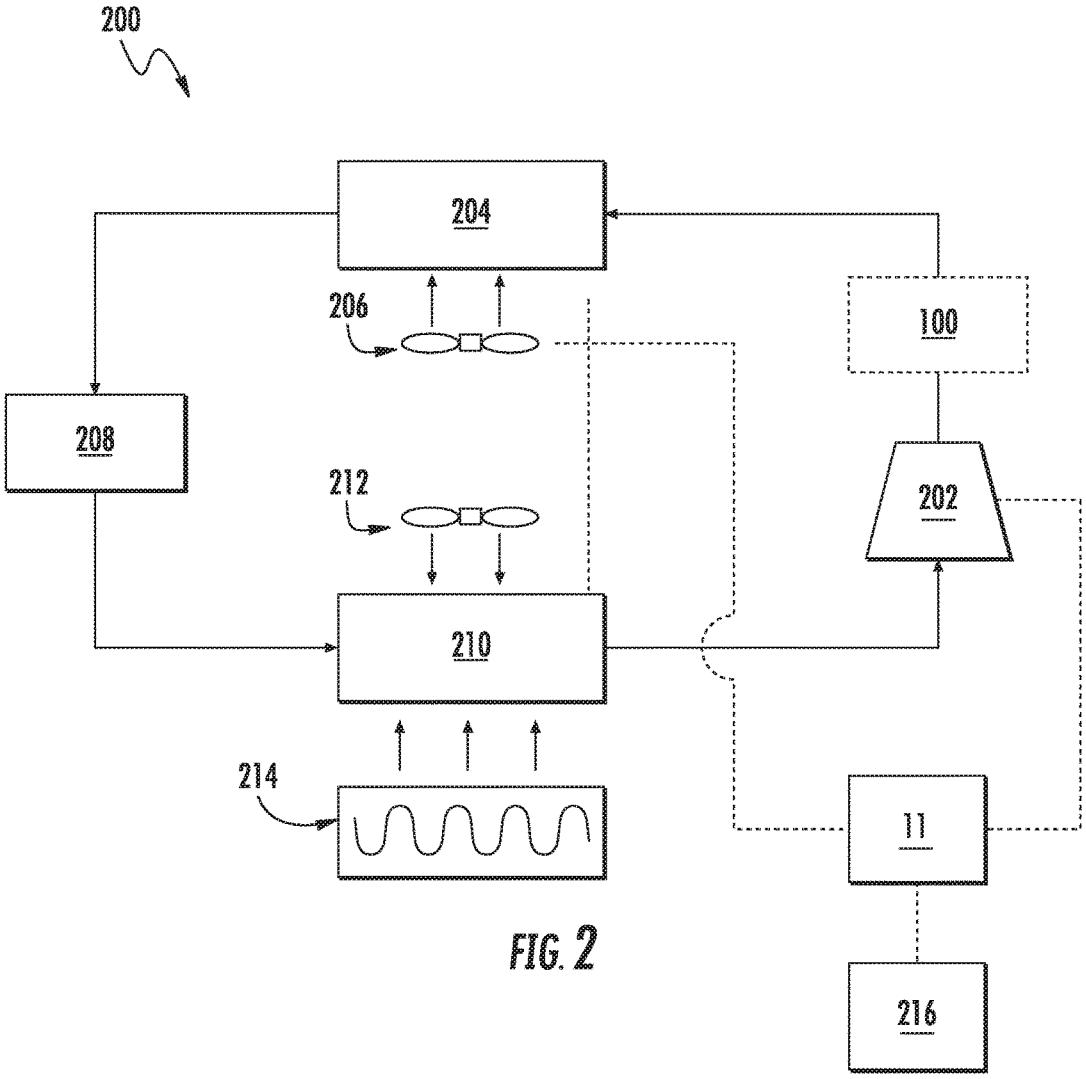
FIG. 2 provides a schematic view of various components of the example embodiments of FIG. 1.

Referring now to FIG. 2, refrigerator appliance 10 may include a refrigeration system 200. In general, refrigeration system 200 is charged with a refrigerant that is flowed through various components and facilitates cooling of the fresh food compartment 12 and the freezer compartment 14. Refrigeration system 200 may be charged or filled with any suitable refrigerant. For example, refrigeration system 200 may be charged with a flammable refrigerant, such as R441A, R600a (i.e., isobutane), R600, R290, etc.

Refrigeration system 200 includes a compressor 202 for compressing the refrigerant, thus raising the temperature and pressure of the refrigerant. Compressor 202 may for example be a variable speed compressor, such that the speed of the compressor 202 can be varied between zero (0) and one hundred (100) percent by controller 11. Refrigeration system 200 may further include a condenser 204, which may be disposed downstream of compressor 202, e.g., in the direction of flow of the refrigerant. Thus, condenser 204 may receive refrigerant from the compressor 202, and may condense the refrigerant by lowering the temperature of the refrigerant flowing therethrough due to, e.g., heat exchange with ambient air. A condenser fan 206 may be used to force air over condenser 204 as illustrated to facilitate heat exchange between the refrigerant and the surrounding air. Condenser fan 206 can be a variable speed fan—meaning the speed of condenser fan 206 may be controlled or set anywhere between and including, e.g., zero (0) and one hundred (100) percent. The speed of condenser fan 206 can be determined by, and communicated to, fan 206 by controller 11.

Refrigeration system 200 further includes an evaporator 210 disposed downstream of the condenser 204. Additionally, an expansion device 208 may be utilized to expand the refrigerant, thus further reduce the pressure of the refrigerant, leaving condenser 204 before being flowed to evaporator 210. Evaporator 210 generally is a heat exchanger that transfers heat from air passing over the evaporator 210 to refrigerant flowing through evaporator 210, thereby cooling the air and causing the refrigerant to vaporize. An evaporator fan 212 may be used to force air over evaporator 210 as illustrated. As such, cooled air is produced and supplied to refrigerated compartments 12, 14 of refrigerator appliance 10. In certain embodiments, evaporator fan 212 can be a variable speed evaporator fan—meaning the speed of fan 212 may be controlled or set anywhere between and including, e.g., zero (0) and one hundred (100) percent. The speed of evaporator fan 212 can be determined by, and communicated to, evaporator fan 212 by controller 11.

Evaporator 210 may be in communication with fresh food compartment 12 and freezer compartment 14 to provide cooled air to compartments 12, 14. Alternatively, refrigeration system 200 may include more two or more evaporators, such that at least one evaporator provides cooled air to fresh food compartment 12 and at least one evaporator provides cooled air to freezer compartment 14. In other embodiments, evaporator 210 may be in communication with any suitable component of the refrigerator appliance 10. For example, in some embodiments, evaporator 210 may be in communication with ice maker 38, such as with an ice compartment of the ice maker 38. From evaporator 210, refrigerant may flow back to and through compressor 202, which may be downstream of evaporator 210, thus completing a closed refrigeration loop or cycle.

As shown in FIG. 2, a defrost heater 214 may be utilized to defrost evaporator 210, i.e., to melt ice that accumulates on evaporator 210. Heater 214 may be positioned adjacent or in close proximity (e.g., below) evaporator 210 within fresh food compartment 12 and/or freezer compartment 14. Heater 214 may be activated periodically; that is, a period of time $t_{ice}$ elapses between when heater 214 is deactivated and when heater 214 is reactivated to melt a new accumulation of ice on evaporator 210. The period of time $t_{ice}$ may be a preprogrammed period such that time $t_{ice}$ is the same between each period of activation of heater 214, or the period of time may vary. Alternatively, heater 214 may be activated based on some other condition, such as the temperature of evaporator 210 or any other appropriate condition.

Additionally, a defrost termination thermostat 216 may be used to monitor the temperature of evaporator 210 such that defrost heater 214 is deactivated when thermostat 216 measures that the temperature of evaporator 210 is above freezing, i.e., greater than zero degrees Celsius (0° C.). In some embodiments, thermostat 216 may send a signal to controller 11 or other suitable device to deactivate heater 214 when evaporator 210 is above freezing. In other embodiments, defrost termination thermostat 216 may comprise a switch such that heater 214 is switched off when thermostat 216 measures that the temperature of evaporator 210 is above freezing.

Figure 3:
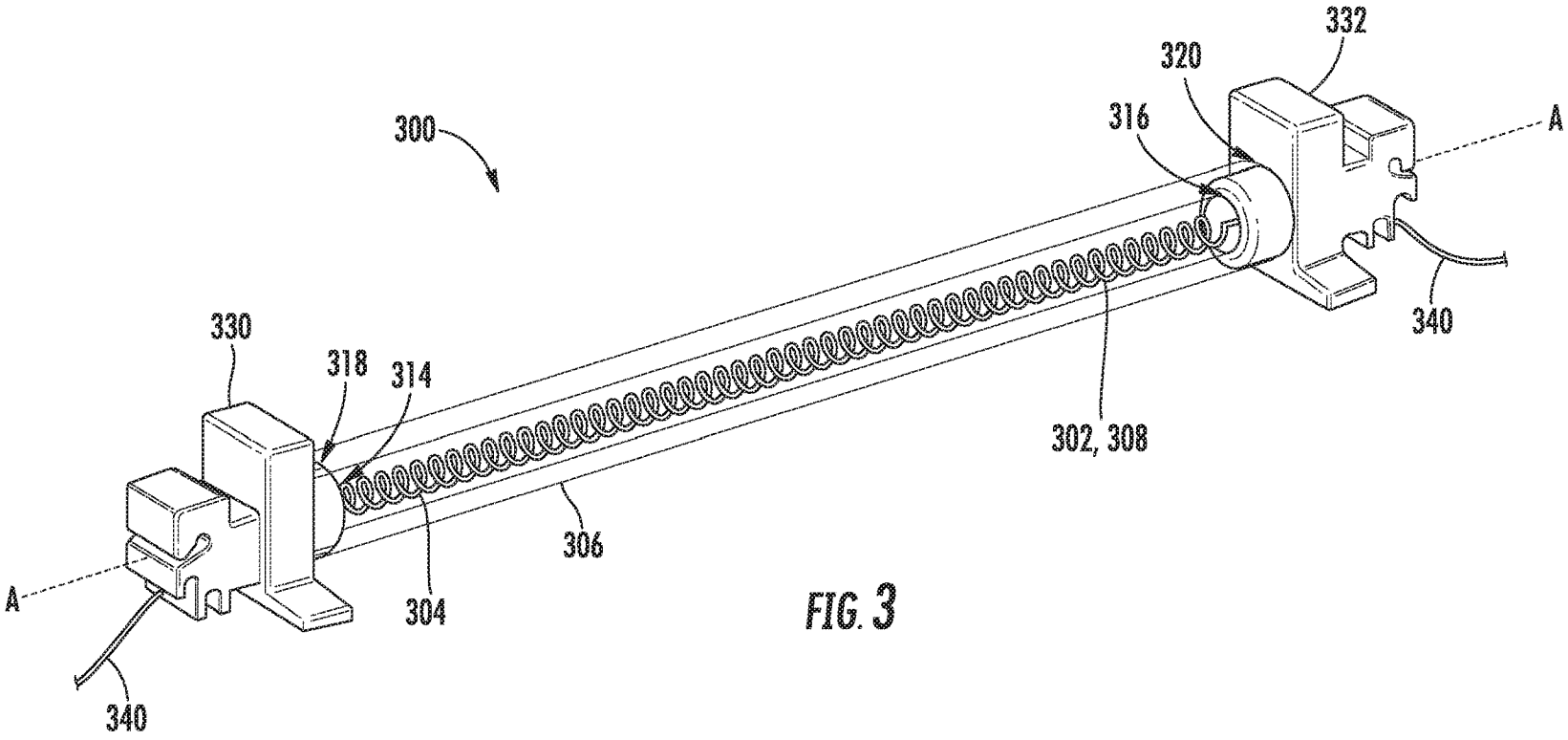
FIG. 3 provides a perspective view of a heating assembly for use in a refrigerator appliance according to example embodiments of the present disclosure.
Figure 4:
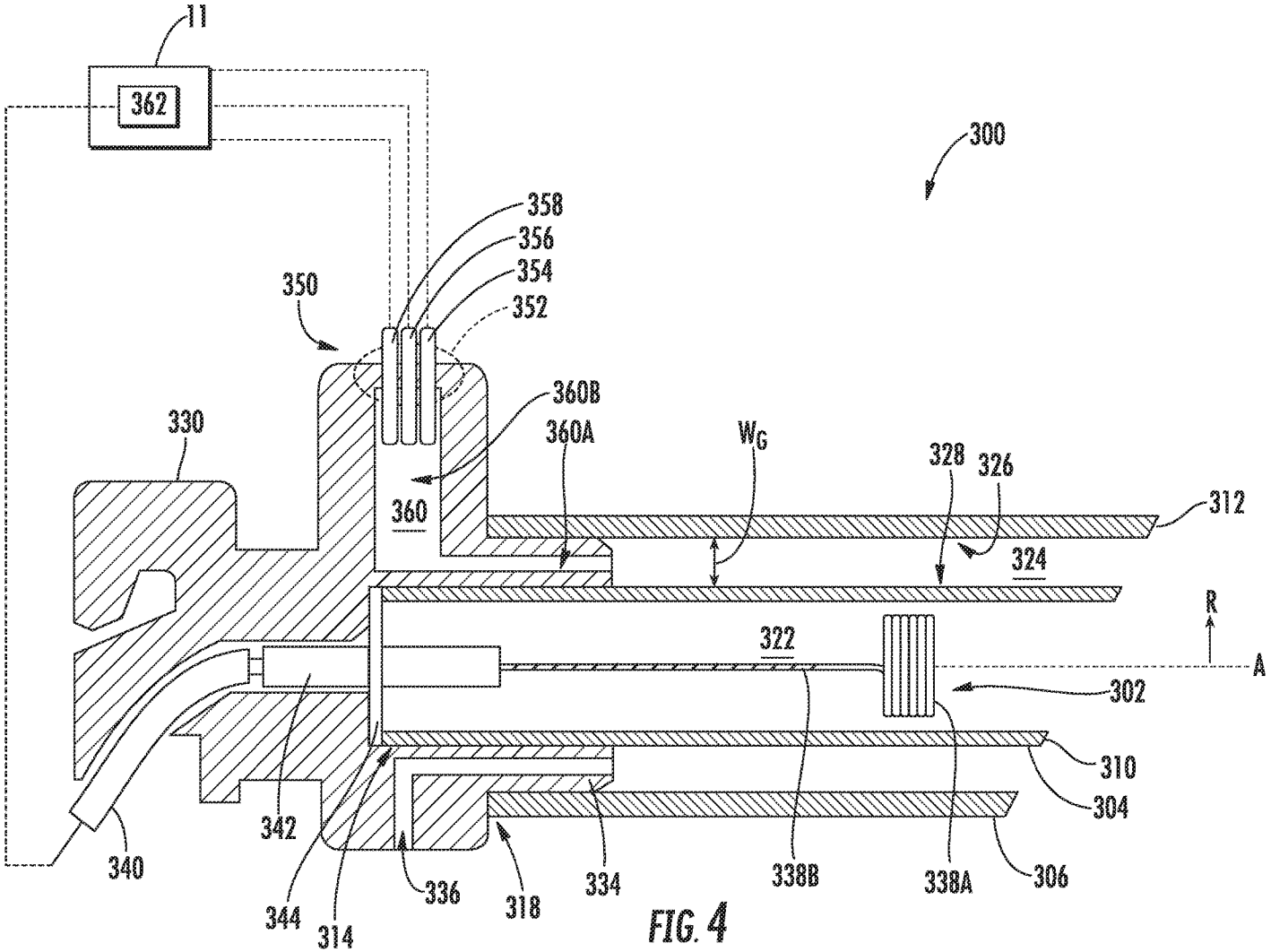
FIG. 4 provides a cross-sectional schematic view of a heating assembly for use in a refrigerator appliance according to example embodiments of the present disclosure.

FIG. 3 provides a perspective view of a heating assembly 300 according to example embodiments of the present disclosure. FIG. 4 provides a cross-sectional schematic view of heating assembly 300. Heating assembly 300 generally includes a resistive heating element 302 and may be used in or with any suitable refrigerator appliance as a defrost heater. For example, heating assembly 300 may be used as defrost heater 214 in refrigeration system 200 to defrost evaporator 210. Thus, heating assembly 300 is discussed in the context of refrigerator appliance 10. As discussed in greater detail below, heating assembly 300 includes features for defrosting evaporator 210 while operating such that a surface temperature of heating assembly 300 (e.g., the temperature at an exterior surface of an outer glass tube 306) is well below a maximum temperature, e.g., an auto-ignition temperature of a flammable refrigerant within evaporator 210.

As used herein, the term "well below" means no less than seventy-five degrees Celsius (75° C.) when used in the context of temperatures. Thus, e.g., the surface temperature of heating assembly 300 may be no less than one-hundred degrees Celsius (100° C.) below the auto-ignition temperature of the flammable refrigerant within evaporator 210 during operation of heating assembly 300 in certain example embodiments.

As shown in FIG. 3, heating assembly 300 includes a pair of glass tubes 304, 306 formed from a suitable material (e.g., quartz, glass-ceramic, etc.). An inner glass tube 304 includes a continuous inner wall 310. Continuous inner wall 310 may be solid and non-permeable to air or water. When assembled, continuous inner wall 310 extends circumferentially about a central axis A. Moreover, continuous inner wall 310 extends along (e.g., parallel to) the central axis A from a first end 314 to a second end 316. Inner glass tube 304 may be formed as a generally hollow member. In turn, continuous inner wall 310 defines a central passage 322 that extends from the first end 314 to the second end 316 of inner glass tube 304. An inner tube opening may be defined at one or both of the first end 314 and second end 316 of inner glass tube 304.

In some embodiments, an outer glass tube 306 is disposed about inner glass tube 304. For instance, outer glass tube 306 may include a continuous outer wall 312 that extends along (e.g., parallel to) the central axis A and/or continuous inner wall 310. Outer wall 312 may be solid and non-permeable to air or water. Moreover, outer wall 312 may extend from a first end 318 to a second end 320 along the central axis A. Outer glass tube 306 may be formed as a generally hollow member. An outer tube opening may be defined at one or both of the first end 318 and second end 320 of outer glass tube 306. At least a portion of inner glass tube 304 between the first end 314 and the second end 316 is contained within (e.g., radially inward from) outer glass tube 306. As shown, a radial gap 324 is defined between outer glass tube 306 and inner glass tube 304, e.g., in a radial direction R. Specifically, radial gap 324 is defined between a radially innermost surface 326 of continuous outer wall 312 and a radially outermost surface 328 of continuous inner wall 310. When assembled, radial gap 324 has width $W_G$ (e.g., constant or minimum width) between radially innermost surface 326 of continuous outer wall 312 and radially outermost surface 328 of continuous inner wall 310. Thus, outer glass tube 306 may be insulated from inner glass tube 304.

One or more end caps 330, 332 are disposed at the ends of the glass tube pair 302, 304. Each end cap 330 and 330 may be formed from any suitable insulating material to limit or restrict conductive heat from passing between the glass tubes 304, 306 (e.g., silicone rubber). In some embodiments, a first end cap 330 is disposed at the first end 314 of inner glass tube 304 and/or the first end 318 of outer glass tube 306. In additional embodiments, a second end cap 332 is disposed at the second end 316 of inner glass tube 304 and/or the second end 320 of outer glass tube 306.

Each end cap 330 and 332 may support a respective end of glass tubes 304, 306. For instance, a tube collar 334 may be formed on one or both end caps 330, 332—e.g., first end cap 330, as shown in FIG. 4. An axial segment of inner glass tube 304 may be held inside, or radially inward from, tube collar 334. Additionally or alternatively, an axial segment of outer glass tube 306 may extend over, or radially outward from, tube collar 334. When assembled, such embodiments of tube collar 334 may thus define width $W_G$ (e.g., radial width) of radial gap 324 and/or seal a portion of radial gap 324. In some embodiments, an air passage 336 extends through tube collar 334 to permit air or gas to pass between radial gap 324 and the ambient environment. For instance, air passage 336 may define a width smaller than a flame quenching diameter for the refrigerant within evaporator 210 (FIG. 2), e.g., to prevent a flame from propagating from the ambient environment to the radial gap 324. Additional or alternative embodiments may include a check valve (not pictured) in communication with air passage 336 to selectively permit air to escape from radial gap 324 without passing thereto. In alternative embodiments, a hermetic seal may be formed between radial gap 324 and the ambient environment, e.g., at the end cap 330.

As shown, resistive heating element 302 is disposed within the glass tubes 304, 306. Specifically, resistive heating element 302 is enclosed within the central passage 322 of inner glass tube 304. In some embodiments, resistive heating element 302 includes a resistive wire 338 formed from a suitable high-resistance material, such as nichrome (i.e., a nickel-chromium alloy), ferrochrome (i.e., an iron-chromium alloy), etc. Resistive wire 338 may be formed as a coil portion 338A (e.g., that is formed about the central axis A) between the first end 314 and the second end 316 of inner glass tube 304. Optionally, a linear portion 338B of the wire may extend from the coil portion 338A towards either the first end 314 or the second end 316. Moreover, some embodiments may include two discrete linear portions extending from opposite ends of the coil portion 338A towards each of the first end 314 and the second end 316 of inner glass tube 304. It is noted that linear portion 338B may be formed as a folded or twisted wire structure that extends, as an example, along or coaxial with the central axis A. In turn, linear portion 338B is generally understood to have a lower surface area density than coil portion 338A. During use, the linear portion 338B may thus operate at a lower temperature than the coil portion 338A.

In example embodiments, a lead wire 340 extends through an end cap 330, 332 (e.g., one or both of first end cap 330 and second end cap 332) and electrically couples resistive wire 338 to a voltage source (not pictured) and/or controller 11. Optionally, a coupling pipe 342 extends between resistive wire 338 and lead wire 340. For instance, coupling pipe 342 may extend through a portion of end cap 330 into central passage 322, as shown in FIG. 4. A positioning plate 344 may support coupling pipe 342, e.g., at each end 314, 316 of inner glass tube 304. Additionally or alternatively, positioning plate 344 may hermetically seal the tube openings of inner glass tube 304, thereby preventing a refrigerant or flame from passing from the ambient environment to the central passage 322.

As shown in FIG. 4, a sensor assembly 350 is provided in communication with another portion of heating assembly 300. Sensor assembly 350 may include, for instance a resistance sensor 362, a temperature sensor 354, a pressure sensor 356, or a humidity sensor 358. In some embodiments, a sensor body 352 is attached to at least one end cap, e.g., first end cap 330. For instance, sensor body 352 may extend into the first end cap 330 such that at least a portion of sensor body 352 is housed within end cap 330. In the illustrated embodiment, sensor body 352 includes a temperature sensor 354, a pressure sensor 356, and a humidity sensor 358. Each of temperature sensor 354, pressure sensor 356, and humidity sensor 358 may detect a corresponding condition within radial gap 324.

Although multiple sensors are provided in the illustrated sensor body 352 embodiment of FIG. 4, alternative embodiments of sensor body 352 may include greater or fewer numbers of sensors. For instance, only a single one of the temperature sensor 354, pressure sensor 356, or humidity sensor 358 is provided for certain embodiments.

In example embodiments, an offset channel 360 is defined within at least one end cap, e.g., first end cap 330. Offset channel 360 generally extends from radial gap 324 in fluid communication therewith. For instance, offset channel 360 may extend through tube collar 334 and to an outer portion of end cap 330. As shown, offset channel 360 may include an axial portion 360A that extends parallel to the central axis A and/or radial gap 324. Offset channel 360 may further include a radial portion 360B that extends outward from (e.g., in an at least partially perpendicular direction) the central axis A and/or radial gap 324. When assembled, offset channel 360 may receive a portion of sensor body 352. In turn, sensor body 352 may be in fluid communication with radial gap 324. Advantageously, sensor body 352 may thus be mounted apart from resistive heating element 302 and maintained in relatively cool location, thereby avoiding damage that may be caused by exposure to high temperatures.

In optional embodiments, sensor assembly 350 includes a resistance sensor 362 that is in electrical communication with resistive heating element 302. For instance, resistance sensor 362 may be mounted on controller 11. Additionally or alternatively, resistance sensor 362 may be electrically coupled to lead wire 340. During use, resistance sensor 362 may thus detect electrical resistance of resistive heating element 302. Specifically, resistance sensor 362 may thus detect electrical resistance through resistance wire 338.

As shown, controller 11 is generally provided in operable communication with heating assembly 300. Specifically, controller 11 may be in operable communication with sensor assembly 350 and/or resistive heating element 302. For instance, controller 11 may be electrically coupled to sensor assembly 350 via one or more signal lines or shared communication busses. Moreover, controller 11 may be electrically coupled to resistive heating element 302 via one or more similar signal lines or shared communication busses, such as lead wire 340.

Figure 5:
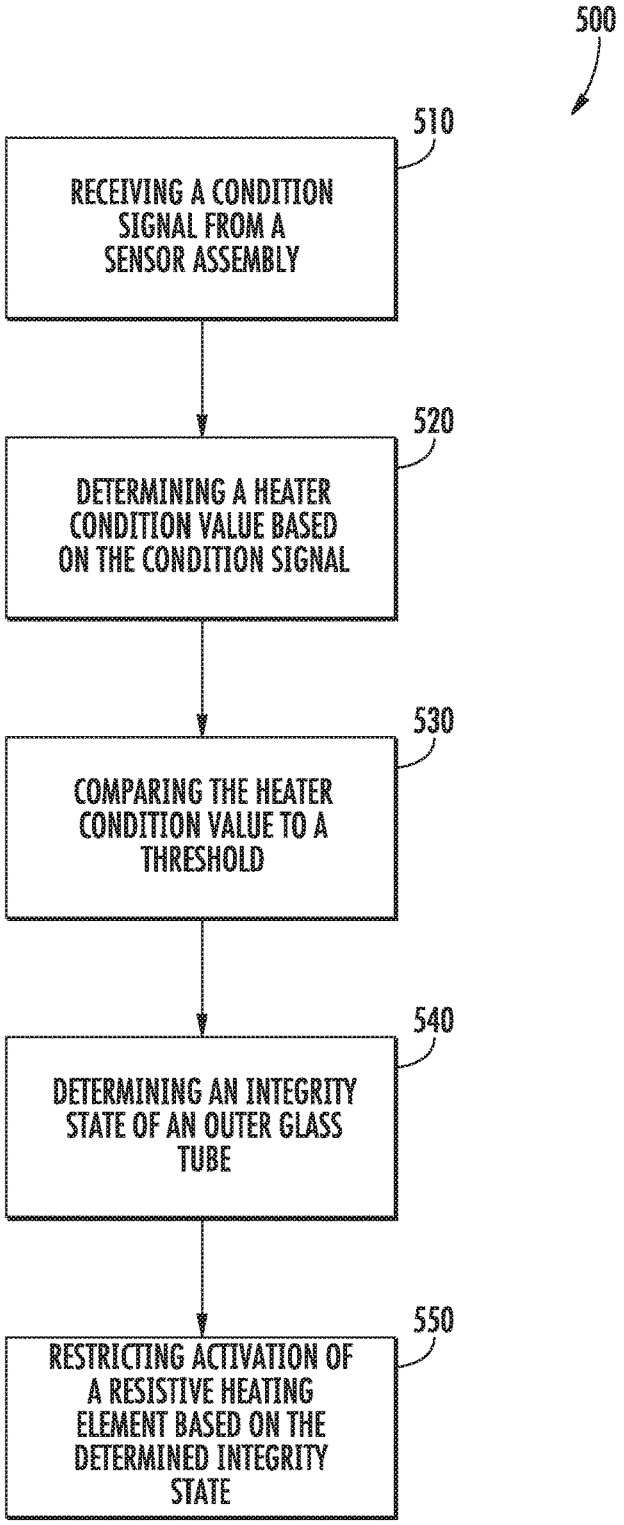
FIG. 5 provides a flow chart illustrating a method of controlling a heating assembly in an appliance according to exemplary embodiments of the present disclosure.

Turning now to FIG. 5, a flow diagram is provided of method 500, according to example embodiments of the present disclosure. Generally, method 500 provides a method of operating refrigerator appliance 10 (e.g., as a heater monitoring sequence). As described above, the refrigerator appliance 10 may include an electrical heater or heating assembly 300 that has a pair of inner and outer glass tubes 304, 306, that define a radial gap 324 therebetween. The heating assembly 300 may further include resistive heating element 302 disposed within the inner glass tube 304. The refrigerator appliance 10 may further include a sensor assembly 350 in operable communication with the resistive heating element 302. Method 500 can be performed, for instance, by the controller 11. As discussed above, controller 11 may be in communication with resistive heating element 302 and sensor assembly 350. Moreover, controller 11 may send signals to, and receive signals from, resistive heating element 302 and sensor assembly 350. Controller 11 may further be in communication with other suitable components of the appliance 10 to facilitate operation of the appliance 10, generally.

FIG. 5 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure, except as otherwise indicated.

As shown in the flow chart of FIG. 5, the example method 500 generally includes steps 510 through 550. At 510, the method 500 includes receiving a condition signal from the sensor assembly. The condition signal may optionally be a resistance signal, a temperature signal, a pressure signal, or a humidity signal. In turn, the condition signal may be received from a resistance sensor, a temperature sensor, a pressure sensor, or a humidity sensor, as described above. If the condition signal is a temperature, pressure, or humidity signal, the condition signal may generally correspond or relate to a temperature, pressure, or humidity condition within the radial gap. Thus, the condition signal may provide an indication of the temperature, pressure, or humidity within the radial gap. If the condition signal is a resistance signal, the condition signal may generally correspond or relate to electrical resistance through the resistive heating element.

In some embodiments, 510 includes receiving a discrete condition signal at a set time point. In other words, 510 may include receiving a condition signal relating to a specific moment or point in time. In additional or alternative embodiments, 510 includes receiving multiple condition signals over a set time period. In other words, 510 may include receiving multiple discrete condition signals at multiple corresponding time points, e.g., to track a certain condition over time.

At 520, the method 500 includes determining a heater condition value based on the condition signal received at 510. The heater condition value may, thus, provide an indication of a physical condition or state at the heater assembly. In certain embodiments, the condition signal corresponds to a condition of air or gas within the radial gap. As an example, the condition value may be a temperature value indicating the air or gas temperature within the radial gap. As another example, the condition value may be a pressure value indicating the air or gas pressure within the radial gap. As yet another example, the condition value may be a humidity value indicating the humidity level of air or gas within the radial gap. In additional or alternative embodiments, the condition signal corresponds to an electrical condition of the resistive heating element. As an example, the condition value may be a resistance value indicating the electrical resistance at or through the resistive heating element.

If receiving a condition signal includes receiving a discrete condition signal at a set time point, the heater condition value may be a contemporary value of a condition at the set time point. In other words, the condition value may indicate a determined physical condition or state at a specific moment or point in time. If receiving a condition signal includes receiving multiple discrete condition signals over a set time period, the heater condition value may be a rate of change value of a condition over the set time period. Thus, the condition value may indicate the determined change in a certain physical condition or state over an elapsed time frame. Optionally, the condition value may be determined or calculated as an absolute value.

At 530, the method 500 includes comparing the heater condition value to a threshold. The threshold may be a specific threshold value or a threshold range. Moreover, the threshold may be predetermined, for example, by experimental data performed with an exemplary or prototypical heating assembly. In some embodiments, the threshold is based on an operating state of the resistive heating element. In additional or alternative embodiments, the threshold is based on an operating state of the sealed system.

Optionally, multiple distinct thresholds may be provided such that a unique threshold is used according to an operating state of the resistive heating element and an operating state of the sealed system. As an example, a first threshold may be provided for comparison to a heater condition value determined or corresponding to when the a) resistive heating element is off or inactive and b) the sealed system is on or active. A second threshold may be provided for comparing to a heater condition value determined when a) the resistive heating element is on or active and b) the sealed system is off or inactive. A third threshold may be provided for comparing to a heater condition value determined when the a) resistive heating element is off or inactive and b) the sealed system is also off or inactive.

At 540, the method 500 includes determining an integrity state of the outer glass tube based on the comparison at 530. For instance, 540 may include determining the outer glass tube is in either a broken or unbroken state. For instance, deviation from the threshold(s) at 530 may indicate either a broken or unbroken state. Certain conditions may thus indicate a broken integrity state. Several non-limiting examples of determined broken integrity states may be given below.

As one example, if the condition signal is a temperature signal, multiple thresholds may be provided, as indicated above. At the first threshold, when the resistive heating element is off or inactive and the sealed system is on or active, a first contemporary temperature value ($T_1$) that is less than a first temperature threshold value ($\beta_1$) may indicate an undesirably cold temperature and a broken integrity state, as shown in equation (1) below. Additionally or alternatively, a first temperature rate of change value ($dT_1/dt$) that is less than a first temperature rate threshold ($\alpha_1$) may indicate rapid cooling and a broken integrity state, as shown in equation (2) below.

$T_1<\beta_1$: Broken Integrity State $T_1\geq\beta_1$: Unbroken Integrity State $dT_1/dt<\alpha_1$: Broken Integrity State (1)

$dT_1/dt\geq\alpha_1$: Unbroken Integrity State (2)

At the second threshold, when the resistive heating element is on or active and the sealed system is off or inactive, a second contemporary temperature value ($T_2$) that is less than a second temperature threshold value ($\beta_2$) may indicate an undesirably cold temperature and a broken integrity state, as shown in equation (3) below. Additionally or alternatively, a second temperature rate of change value ($dT_2/dt$) that is less than a second temperature rate threshold ($\alpha_2$) may indicate rapid cooling and a broken integrity state, as shown in equation (4) below.

$T_2<\beta_2$: Broken Integrity State $T_2\geq\beta_2$: Unbroken Integrity State $dT_2/dt<\alpha_2$: Broken Integrity State (3)

$dT_2/dt\geq\alpha_2$: Unbroken Integrity State (4)

At the third threshold, when the resistive heating element is off or inactive and the sealed system is off or inactive, a third temperature rate of change value ($dT_3/dt$) that is greater than a third temperature rate threshold ($\alpha_3$) may indicate excessive heat (e.g., due to reduced insulation) and a broken integrity state, as shown in equation (5) below.

$dT_3/dt>\alpha_3$: Broken Integrity State $dT_3/dt\leq\alpha_3$: Unbroken Integrity State (5)

As another example, if the condition signal is a pressure signal, multiple thresholds may be provided, as indicated above. At the first threshold, when the resistive heating element is off or inactive and the sealed system is on or active, a first contemporary pressure value ($P_1$) that is greater than a first pressure threshold value ($\zeta_1$) may indicate a undesired undesirably high pressure and a broken integrity state, as shown in equation (6) below. Additionally or alternatively, a first pressure absolute rate of change value (abs($dP_1/dt$)) that is greater than a first pressure rate threshold ($\varepsilon_1$) may indicate rapid pressure change and a broken integrity state, as shown in equation (7) below.

$P_1>\zeta_1$: Broken Integrity State $P_1\leq\zeta_1$: Unbroken Integrity State $\mathrm{abs}(dP_1/dt)>\varepsilon_1$: Broken Integrity State (6)

$\mathrm{abs}(dP_1/dt)\leq\varepsilon_1$: Unbroken Integrity State (7)

At the second threshold, when the resistive heating element is on or active and the sealed system is off or inactive, a second contemporary pressure value ($P_2$) that is less than a second pressure threshold value ($\zeta_2$) may indicate an lack of proper pressurization and a broken integrity state, as shown in equation (8) below. Additionally or alternatively, a second pressure rate of change value ($dP_2/dt$) that is less than a second pressure rate threshold ($\varepsilon_2$) may indicate an undesirably slow pressurization and a broken integrity state, as shown in equation (9) below.

$P_2<\zeta_2$: Broken Integrity State $P_2\geq\zeta_2$: Unbroken Integrity State $dP_2/dt<\varepsilon_2$: Broken Integrity State (8)

$dP_2/dt\geq\varepsilon_2$: Unbroken Integrity State (9)

At the third threshold, when the resistive heating element is off or inactive and the sealed system is off or inactive, a third contemporary pressure value ($P_3$) that is greater than a third pressure threshold value ($\zeta_3$) may indicate a undesirably high pressure and a broken integrity state, as shown in equation (10) below.

$P_3>\zeta_3$: Broken Integrity State $P_3<\zeta_3$: Unbroken Integrity State (10)

As yet another example, if the condition signal is a humidity signal, multiple thresholds may be provided, as indicated above. At the first threshold, when the resistive heating element is off or inactive and the sealed system is on or active, a first contemporary humidity value ($H_1$) that is greater than a first humidity threshold value ($\delta_1$) may indicate an undesirably high humidity level (e.g., received from the ambient environment) and a broken integrity state, as shown in equation (11) below. Additionally or alternatively, a first humidity absolute rate of change value (abs($dH_1/dt$)) that is greater than a first humidity rate threshold ($\gamma_1$) may indicate rapid humidity change and a broken integrity state, as shown in equation (12) below.

$H_1>\delta_1$: Broken Integrity State $H_1\leq\delta_1$: Unbroken Integrity State $\mathrm{abs}(dH_1/dt)>\gamma_1$: Broken Integrity State (11)

$\mathrm{abs}(dH_1/dt)\leq\gamma_1$: Unbroken Integrity State (12)

At the second threshold, when the resistive heating element is on or active and the sealed system is off or inactive, a second contemporary humidity value ($H_2$) that is greater than a second humidity threshold value ($\delta_2$) may indicate an undesirably high humidity level (e.g., received from the ambient environment) and a broken integrity state, as shown in equation (13) below. Additionally or alternatively, a second humidity absolute rate of change value (abs($dH_2/dt$)) that is greater than a second humidity rate threshold ($\gamma_2$) may indicate rapid humidity change and a broken integrity state, as shown in equation (14) below.

$H_2>\delta_2$: Broken Integrity State $H_2\leq\delta_2$: Unbroken Integrity State $\text{abs}(dH_2/dt)>\gamma_2$: Broken Integrity State (13)

$\text{abs}(dH_2/dt)\leq\gamma_2$: Unbroken Integrity State (14)

At the third threshold, when the resistive heating element is off or inactive and the sealed system is off or inactive, a third contemporary humidity value ($H_3$) that is greater than a third humidity threshold value ($\delta_3$) may indicate an undesirably high humidity level (e.g., received from the ambient environment) and a broken integrity state, as shown in equation (15) below.

$H_3>\delta_3$: Broken Integrity State $H_3\leq\delta_3$: Unbroken Integrity State (15)

As a further example, if the condition signal is a resistance signal, multiple thresholds may be provided, as indicated above. At the first threshold, when the resistive heating element is off or inactive and the sealed system is on or active, a first contemporary resistance value ($R_1$) that is less than a first resistance threshold value ($\theta_1$) may indicate an undesirably cold heater operation and a broken integrity state, as shown in equation (16) below. Additionally or alternatively, a first resistance rate of change value ($dR_1/dt$) that is less than a first resistance rate threshold ($\eta_1$) may indicate rapid cooling and a broken integrity state, as shown in equation (17) below.

$R_1<\theta_1$: Broken Integrity State $R_1\geq\theta_1$: Unbroken Integrity State $dR_1/dt<\eta_1$: Broken Integrity State (16)

$dR_1/dt\geq\eta_1$: Unbroken Integrity State (17)

At the second threshold, when the resistive heating element is on or active and the sealed system is off or inactive, a second contemporary resistance value ($R_2$) that is less than a second resistance threshold value ($\theta_2$) may indicate an undesirably cold heater operation and a broken integrity state, as shown in equation (18) below. Additionally or alternatively, a second resistance rate of change value ($dR_2/dt$) that is less than a second resistance rate threshold ($\eta_2$) may indicate rapid cooling and a broken integrity state, as shown in equation (19) below.

$R_2<\theta_2$: Broken Integrity State $R_2\geq\theta_2$: Unbroken Integrity State $dR_2/dt<\eta_2$: Broken Integrity State (18)

$dR_2/dt\geq\eta_2$: Unbroken Integrity State (19)

At the third threshold, when the resistive heating element is off or inactive and the sealed system is off or inactive, a third resistance rate of change value ($dR_3/dt$) that is greater than a third resistance rate threshold ($\eta_3$) may indicate heating (e.g., due to reduced insulation) and a broken integrity state, as shown in equation (20) below.

$dR_3/dt>\eta_3$: Broken Integrity State $dR_3/dt\leq\eta_3$: Unbroken Integrity State (20)

Returning to FIG. 5, at 550, the method 500 includes restricting activation of the resistive heating element based on the determined integrity state at 540. For instance, activation of the resistive heating element may be restricted when a broken integrity state is determined. If the resistive heating element is active at or before this step, 550 may include deactivating the resistive heating element. If the resistive heating element is inactive at or before this step, 550 may include preventing the resistive heating element from being activated. In contrast, if an unbroken integrity state is determined, operation of appliance, including resistive heating element, may proceed or continue unabated.

In additional or alternative embodiments, an audio and/or visual alert may be transmitted to a user, e.g., at the control panel, upon determining a broken integrity state. Moreover, further additional or alternative steps may be taken to ensure refrigerant does not ignite or otherwise interact with resistive heating element.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber;

a sealed system comprising an evaporator, the evaporator disposed at the chilled chamber; and an electrical heater positioned adjacent the evaporator, the electrical heater comprising an inner glass tube comprising a continuous inner wall defining a central passage extending from a first end to a second end, a resistive heating element disposed within the central passage, an outer glass tube comprising a continuous outer wall disposed about the inner glass tube, wherein a radial gap is defined between the outer glass tube and the inner glass tube, a first end cap positioned on the outer glass tube and the inner glass tube at the first end, a second end cap positioned on the outer glass tube and the inner glass tube at the second end, and a sensor assembly disposed in fluid communication with the radial gap.

2. The refrigerator appliance of claim 1, wherein the sensor assembly includes a temperature sensor, a pressure sensor, or a humidity sensor.

3. The refrigerator appliance of claim 1, wherein the sensor assembly includes a sensor body attached to the first end cap.

4. The refrigerator appliance of claim 3, wherein the first end cap defines an offset gas channel in fluid communication with the radial gap, and wherein the sensor body extends into the offset gas channel.

5. The refrigerator appliance of claim 1, further comprising a controller operably coupled to the electrical heater, wherein the controller is configured to initiate a heater monitoring sequence, the heater monitoring sequence comprising receiving a condition signal from the sensor assembly, determining a heater condition value based on the condition signal, comparing the heater condition value to a threshold, and determining an integrity state of the outer glass tube based on the comparing.

6. The refrigerator appliance of claim 5, wherein the threshold is based on an operating state of the resistive heating element.

7. The refrigerator appliance of claim 5, wherein the threshold is based on an operating state of the sealed system.

8. A defrost heater for a refrigeration assembly, the defrost heater comprising:

an inner glass tube comprising a continuous inner wall defining a central passage extending from a first end to a second end;

a resistive heating element disposed within the central passage;

an outer glass tube comprising a continuous outer wall disposed about the inner glass tube, wherein a radial gap is defined between the outer glass tube and the inner glass tube;

a first end cap positioned on the outer glass tube and the inner glass tube at the first end;

a second end cap positioned on the outer glass tube and the inner glass tube at the second end; and a sensor assembly disposed in fluid communication with the radial gap.

9. The defrost heater of claim 8, wherein the sensor assembly includes a temperature sensor, a pressure sensor, or a humidity sensor.

10. The defrost heater of claim 8, wherein the sensor assembly includes a sensor body attached to the first end cap.

11. The defrost heater of claim 10, wherein the first end cap defines an offset gas channel in fluid communication with the radial gap, and wherein the sensor body extends into the offset gas channel.

12. The defrost heater of claim 8, further comprising a controller operably coupled to the sensor assembly, wherein the controller is configured to initiate a heater monitoring sequence, the heater monitoring sequence comprising receiving a condition signal from the sensor assembly, determining a heater condition value based on the condition signal, comparing the heater condition value to a threshold, and determining an integrity state of the outer glass tube based on the comparing.

13. The defrost heater of claim 12, wherein the threshold is based on an operating state of the resistive heating element.

14. A method of operating a refrigeration system, the refrigeration system comprising an electrical heater comprising a pair of an inner and an outer glass tube defining a radial gap therebetween, and a resistive heating element disposed within the inner glass tube, the refrigeration system further comprising a sensor assembly in operable communication with the electrical heater, the method comprising:

receiving a condition signal from the sensor assembly;

determining a heater condition value based on the condition signal;

comparing the heater condition value to a threshold;

determining an integrity state of the outer glass tube based on the comparing; and restricting activation of the resistive heating element based on the determined integrity state.

15. The method of claim 14, wherein the sensor assembly is in operable communication with the radial gap, and wherein the condition signal corresponds to a condition of gas within the radial gap.

16. The method of claim 15, wherein the condition signal is a temperature signal, a pressure signal, or a humidity signal.

17. The method of claim 14, wherein the sensor assembly is in operable communication with the resistive heating element, and wherein the condition signal corresponds to an electrical condition of the resistive heating element.

18. The method of claim 14, wherein receiving a condition signal includes receiving a discrete condition signal at a set time point, and wherein the heater condition value is a contemporary value of a condition at the set time point.

19. The method of claim 14, wherein receiving a condition signal includes receiving multiple discrete condition signals over a set time period, and wherein the heater condition value is rate of change value of a condition over the set time period.

20. The method of claim 19, wherein the heater condition value is an absolute rate of change value.

* * * * *